US010135141B2

(12) United States Patent
Huang et al.

(10) Patent No.: US 10,135,141 B2
(45) Date of Patent: Nov. 20, 2018

(54) MOBILE DEVICE

(71) Applicant: Acer Incorporated, New Taipei (TW)

(72) Inventors: Shih-Ting Huang, New Taipei (TW); Kun-Sheng Chang, New Taipei (TW); Ching-Chi Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 1 day.

(21) Appl. No.: 15/436,346

(22) Filed: Feb. 17, 2017

(65) Prior Publication Data

US 2018/0131075 A1 May 10, 2018

(30) Foreign Application Priority Data

Nov. 4, 2016 (TW) ..... 105135839 A

(51) Int. Cl.

| | |
|---|---|
| ***H01Q 9/04*** | (2006.01) |
| ***H01Q 7/00*** | (2006.01) |
| ***H01Q 1/24*** | (2006.01) |
| ***H01Q 9/42*** | (2006.01) |
| ***H01Q 5/364*** | (2015.01) |
| ***H01Q 5/371*** | (2015.01) |
| *H01Q 1/48* | (2006.01) |

(52) U.S. Cl.

CPC ..... *H01Q 9/0421* (2013.01); *H01Q 1/243* (2013.01); *H01Q 5/364* (2015.01); *H01Q 5/371* (2015.01); *H01Q 7/00* (2013.01); *H01Q 9/42* (2013.01); *H01Q 1/48* (2013.01)

(58) Field of Classification Search

CPC ..... H01Q 1/38

See application file for complete search history.

(56) References Cited

U.S. PATENT DOCUMENTS

| | | | | |
|---|---|---|---|---|
| 7,619,572 | B2 | 11/2009 | Su et al. | |
| 2010/0134366 | A1* | 6/2010 | Yu | H01Q 1/38 343/700 |
| 2016/0064820 | A1 | 3/2016 | Kim et al. | |

FOREIGN PATENT DOCUMENTS

| | | |
|---|---|---|
| TW | I531124 | 4/2016 |

* cited by examiner

*Primary Examiner* — Graham Smith
(74) *Attorney, Agent, or Firm* — J.C. Patents

(57) ABSTRACT

A mobile device includes a ground element and an antenna element. The antenna element includes a first radiation portion, a second radiation portion, and a third radiation portion. The first radiation portion is electrically connected between a feeding point and an edge of the ground element, and the antenna element operates in a first frequency band through a first path formed by the first radiation portion. A first end of the second radiation portion is electrically connected to the first radiation portion, and a second end of the second radiation portion is a first open end. The third radiation portion is electrically connected between the second radiation portion and the edge of the ground element. The antenna element operates in a second frequency band through a second path formed by the second radiation portion and the third radiation portion.

18 Claims, 3 Drawing Sheets

MOBILE DEVICE

CROSS-REFERENCE TO RELATED APPLICATION

This application claims the priority benefit of Taiwan application serial no. 105135839, filed on Nov. 4, 2016. The entirety of the above-mentioned patent application is hereby incorporated by reference herein and made a part of this specification.

BACKGROUND OF THE INVENTION

Field of the Invention

The invention relates to a mobile device, and particularly relates to a mobile device including an antenna element.

Description of Related Art

In recent years, mobile devices (e.g., tablet computers, notebooks) with metal texture are favored by consumers. Thus, the mobile devices are mostly provided with a casing body with metal texture, such as a metal back cover, so as to highlight the uniqueness and appearance design of products. However, a metal environment formed by the casing body of the mobile device often induces a capacitance effect. Thereby, the performance of an antenna element is affected. For example, an equivalent capacitance may be formed between the metal back cover and the antenna element of the mobile device, and the formed equivalent capacitance often leads to the reduction of radiation efficiency of the antenna element. Thereby, communication quality of the mobile device is reduced.

SUMMARY OF THE INVENTION

The invention provides a mobile device including an antenna element capable of operating in a first frequency band and a second frequency band. The antenna element is electrically connected to a ground element through a first radiation portion and a third radiation portion respectively. Thereby, the influence caused by the capacitance effect on the antenna element in the metal environment can be reduced, so as to improve the performance of the antenna element and the communication quality of the mobile device.

The invention provides a mobile device including a ground element and an antenna element. The antenna element includes a first radiation portion, a second radiation portion, and a third radiation portion. The first radiation portion is electrically connected between a feeding point and an edge of the ground element, and includes a first section extending along the edge of the ground element. The first radiation portion foul's a first path extending from the feeding point to the edge of the ground element, and the antenna element operates in a first frequency band through the first path. A first end of the second radiation portion is electrically connected to the first radiation portion, and a second end of the second radiation portion is a first open end. The third radiation portion is electrically connected between the second radiation portion and the edge of the ground element. The second radiation portion and the third radiation portion are disposed between the first section and the edge of the ground element. Additionally, the second radiation portion and the third radiation portion form a second path extending from the first open end to the edge of the ground element, and the antenna element operates in a second frequency band through the second path.

According to an embodiment of the invention, the first radiation portion forms a loop antenna structure, and the second radiation portion and the third radiation portion form an inverted-F antenna structure.

Based on the above, the mobile device of the invention may form the first path and the second path, so as to operate in the first frequency band and the second frequency band. Additionally, the antenna element may be electrically connected to the ground element through the first radiation portion and the third radiation portion respectively. Thereby, the influence caused by the capacitance effect on the antenna element in the metal environment can be reduced, so as to improve the performance of the antenna element and the communication quality of the mobile device.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
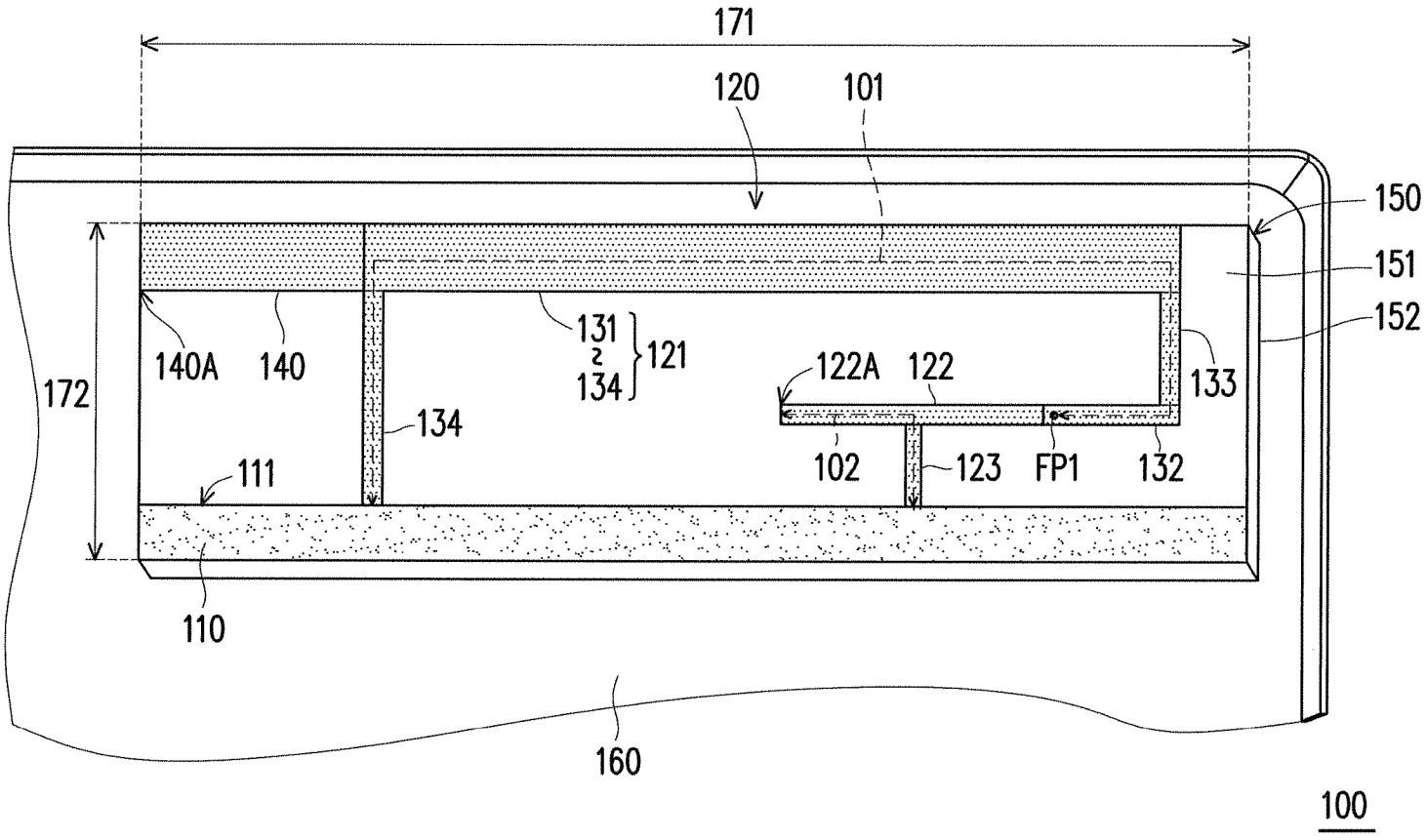
FIG. 1 is a schematic diagram of a mobile device according to an embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 is a schematic diagram of a mobile device according to an embodiment of the invention. As shown in FIG. 1, a mobile device 100 includes a ground element 110 and an antenna element 120. The ground element 110 includes an edge 111. The antenna element 120 includes a first radiation portion 121, a second radiation portion 122, and a third radiation portion 123.

The first radiation portion 121 is electrically connected between a feeding point FP1 and the edge 111 of the ground element 110, and the first radiation portion 121 may form a first path 101 extending from the feeding point FP1 to the edge 111 of the ground element 110. A first end of the second radiation portion 122 is electrically connected to the first radiation portion 121, and a second end of the second radiation portion 122 is a first open end 122A. The third radiation portion 123 is electrically connected between the second radiation portion 122 and the edge 111 of the ground element 110. The second radiation portion 122 and the third radiation portion 123 may form a second path 102 extending from the first open end 122A to the edge 111 of the ground element 110.

In operation, the antenna element 120 may receive a feeding signal from a transceiver (not shown) in the mobile device 100 through the feeding point FP1. For example, the antenna element 120 may be electrically connected to the transceiver through a coaxial cable (not shown), wherein an inner conductor of the coaxial cable is electrically connected to the feeding point FP1, and an outer conductor of the coaxial cable is electrically connected to the ground element 110. In the excitation of the feeding signal, the antenna element 120 may operate in a first frequency band through the first path 101, and the antenna element 120 may operate in a second frequency band through the second path 102.

It should be mentioned that the first radiation portion 121 and the third radiation portion 123 in the antenna element 120 are both electrically connected to the ground element 110. That is, the antenna element 120 may form a short-circuit path using the first radiation portion 121 and the third radiation portion 123 respectively. Thereby, an amount of inductance of the antenna element 120 may be increased. Thus, the influence caused by the capacitance effect on the antenna element 120 in the metal environment can be reduced, so as to improve the performance of the antenna element 120 and the communication quality of the mobile device 100.

For example, the first radiation portion 121 may form a loop antenna structure short-circuited to the ground element 110, and the first path 101 is equivalent to a resonant path of the loop antenna structure. In operation, the loop antenna structure may operate in the first frequency band, and a length of the resonant path of the loop antenna structure (i.e., a length of the first path 101) is ½ wavelength of the lowest frequency of the first frequency band. Additionally, the loop antenna structure itself has an inductivity. Thus, the influence caused by the capacitance effect on the loop antenna structure in the metal environment can be reduced.

On the other hand, the second radiation portion 122 and the third radiation portion 123 may form an inverted-F antenna structure with a short-circuit portion. A first end of the second radiation portion 122 is equivalent to a feeding end of the inverted-F antenna structure. The third radiation portion 123 is equivalent to the short-circuit portion of the inverted-F antenna structure, and the second path 102 is equivalent to a resonant path of the inverted-F antenna structure. In operation, the inverted-F antenna structure may operate in the second frequency band, and a length of the resonant path of the inverted-F antenna structure (i.e., a length of the second path 102) is ¼ wavelength of the lowest frequency of the second frequency band. Additionally, a short-circuit end of the inverted-F antenna structure may generate an inductivity. Thus, the influence caused by the capacitance effect on the inverted-F antenna structure in the metal environment can be reduced.

It should be mentioned that the short-circuit portion of the inverted-F antenna structure may form a stronger inductivity. Therefore, in the overall arrangement, the second radiation portion 122 and the third radiation portion 123 used to form the inverted-F antenna structure are more adjacent to the ground element 110 compared to the first radiation portion 121. Thus, the influence caused by the capacitance effect induced by the ground element 110 on the antenna element 120 can be reduced. Additionally, the inverted-F antenna structure may be disposed between the loop antenna structure and the ground element 110.

For example, the first radiation portion 121 includes a first section 131, and the first section 131 extends along the edge 111 of the ground element 110. The second radiation portion 122 and the third radiation portion 123 are disposed between the first section 131 and the edge 111 of the ground element 110. That is, the third radiation portion 123, the second radiation portion 122, and the first section 131 are sequentially arranged along a direction perpendicular to the edge 111 of the ground element 110. Thereby, the second radiation portion 122 and the third radiation portion 123 may be surrounded by the first radiation portion 121. That is, the first to the third radiation portions 121-123 may be disposed at the same side (e.g., the first to the third radiation portions 121-123 are mostly located at a left side of the feeding point FP1). Thereby, the size of the antenna element 120 may be reduced, which is helpful for the miniaturization of the mobile device 100.

Furthermore, the first radiation portion 121 further includes a second section 132, a third section 133, and a fourth section 134. The second section 132 extends along the edge 111 of the ground element 110. Additionally, a first end of the second section 132 has the feeding point FP1 and is electrically connected to a first end of the second radiation portion 122. The third section 133 is electrically connected between a second end of the second section 132 and a first end of the first section 131. The fourth section 134 is electrically connected between a second end of the first section 131 and the edge 111 of the ground element 110. Additionally, the second radiation portion 122 is disposed between the second section 132 and the fourth section 134. In an embodiment, the first section 131, the second section 132, and the second radiation portion 122 are parallel to the edge 111 of the ground element 110, and the third section 133, the fourth section 134, and the third radiation portion 123 are perpendicular to the edge 111 of the ground element 110.

As shown in FIG. 1, in an embodiment, the antenna element 120 further includes an extension portion 140. A first end of the extension portion 140 is electrically connected to a second end of the first section 131, and a second end of the extension portion 140 is a second open end 140A. Additionally, the extension portion 140 extends along the edge 111 of the ground element 110. For example, the extension portion 140 may be parallel to the edge 111 of the ground element 110. In operation, the extension portion 140 may be used to adjust an impedance matching of the antenna element 120 in a double frequency band of the first frequency band. Thereby, it is helpful to expand the second frequency band covered by the antenna element 120.

Figure 2:
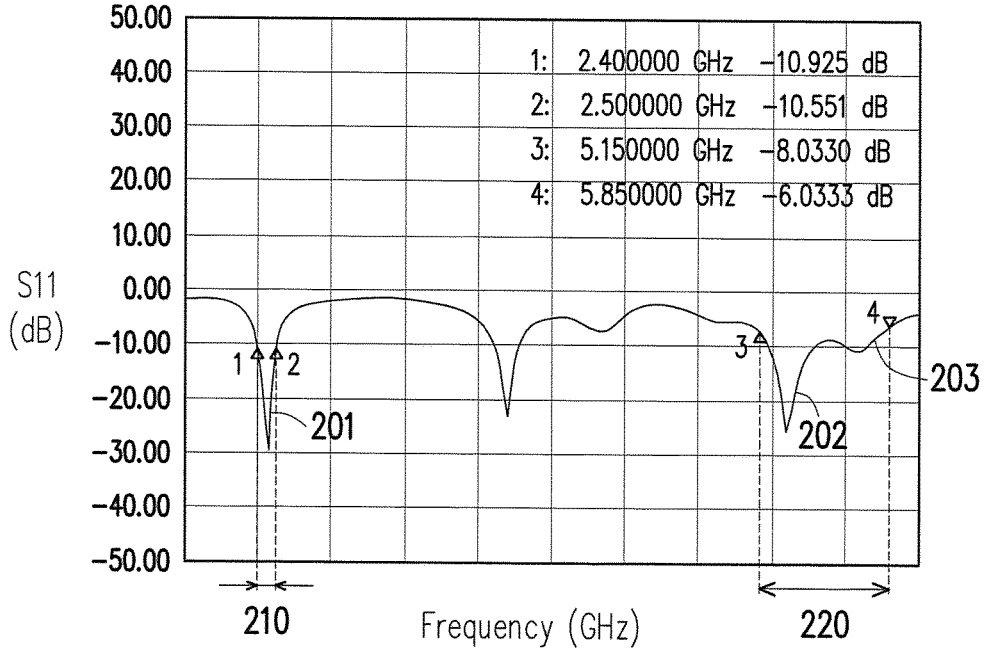
FIG. 2 is an S parameter (S11) diagram of an antenna element according to an embodiment of the invention.

For example, FIG. 2 is an S parameter (S11) diagram of an antenna element according to an embodiment of the invention. As shown in FIG. 2, the first radiation portion 121 may generate a first resonant mode 201 and a double frequency mode 202 through the first path 101, such that the antenna element 120 may cover the first frequency band 210 (i.e., 2.4 GHz frequency band) and a double frequency band of the first frequency band. Additionally, the second radiation portion 122 and the third radiation portion 123 may generate a second resonant mode 203, and the second resonant mode 203 may be combined with the double frequency mode 202, such that the antenna element 120 may cover the second frequency band 220 (i.e., 5 GHz frequency band). The extension portion 140 may be used to adjust the impedance of the first radiation portion 121 in the double frequency mode 202. Thereby, a bandwidth of the double frequency band of the first frequency band may be increased, so as to expand a bandwidth of the second frequency band 220. For example, a frequency range of 5 GHz frequency band is 5150 MHz~5850 MHz.

As shown in FIG. 1, in an embodiment, the mobile device 100 further includes a substrate 150 and a metal casing body 160. The substrate 150 includes a surface 151 and a surface 152 opposite to each other. The ground element 110 and the antenna element 120 are disposed on the surface 151 of the substrate 150. In other words, the antenna element 120 may be a planar antenna, for example. Additionally, in an embodiment, the first to the fourth sections 131~134, the second radiation portion 122, the third radiation portion 123, and the extension portion 140 in the antenna element 120 may be respectively composed of a planar metal wire.

Figure 3:
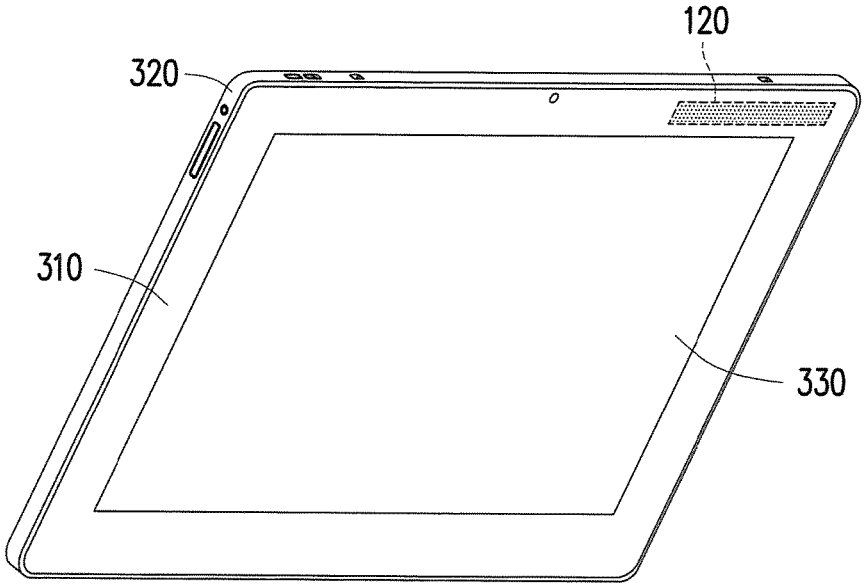
FIG. 3 is a schematic appearance diagram of a mobile device according to an embodiment of the invention.

Furthermore, the surface 152 of the substrate 150 faces the metal casing body 160. That is, the antenna element 120 is opposite to the metal casing body 160 separated by the substrate 150. Additionally, the metal casing body 160 is electrically connected to the ground element 110. That is, the metal casing body 160 may be regarded as a system ground plane of the antenna element 120. An orthogonal projection of the antenna element 120 on the substrate 150 and an orthogonal projection of the metal casing body 160 on the substrate 150 are overlapped with each other. In an embodiment, the mobile device 100 may be a tablet computer, for example, and the metal casing body 160 may be a metal back cover of the tablet computer, for example. For example, FIG. 3 is a schematic appearance diagram of a mobile device according to an embodiment of the invention. As shown in FIG. 3, the mobile device 100 includes a frame 310, a metal back cover 320, and a touch display 330. The touch display 330 is surrounded by the frame 310, and the antenna element 120 may be disposed in an accommodating space formed by the frame 310 or/and the metal back cover 320. Additionally, parts of or all of the metal back cover 320 may be composed of the metal casing body 160.

It should be mentioned that the amount of inductance of the antenna element 120 may be increased through the short-circuit path formed by the first radiation portion 121 and the third radiation portion 123. Thus, the influence caused by the capacitance effect induced by the metal back cover 320 (e.g., the metal casing body 160) can be resisted, such as the influence caused by the equivalent capacitance between the metal back cover 320 and the antenna element 120. Thereby, in the overall arrangement, the metal back cover 320 does not need to be provided with a corresponding antenna window for the antenna element 120 (i.e., an antenna clearance area), so as to improve the integrity and the aesthetics of the metal back cover 320 on the appearance design.

Figure 4:
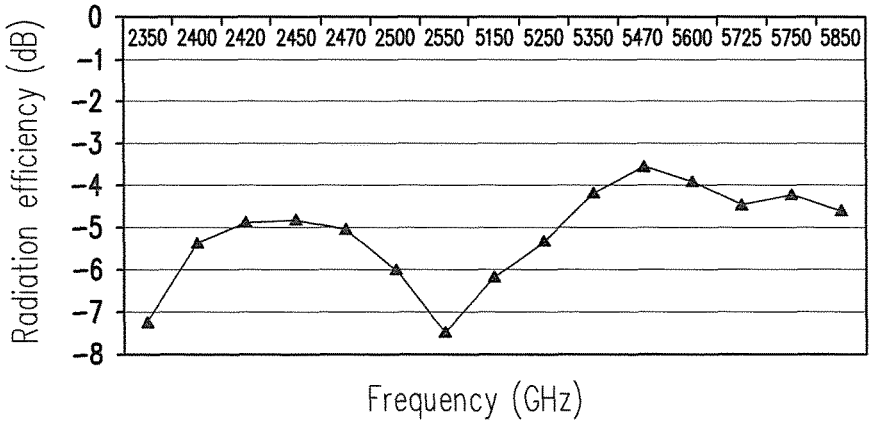
FIG. 4 is a radiation efficiency diagram of an antenna element according to an embodiment of the invention.
Figure 5:
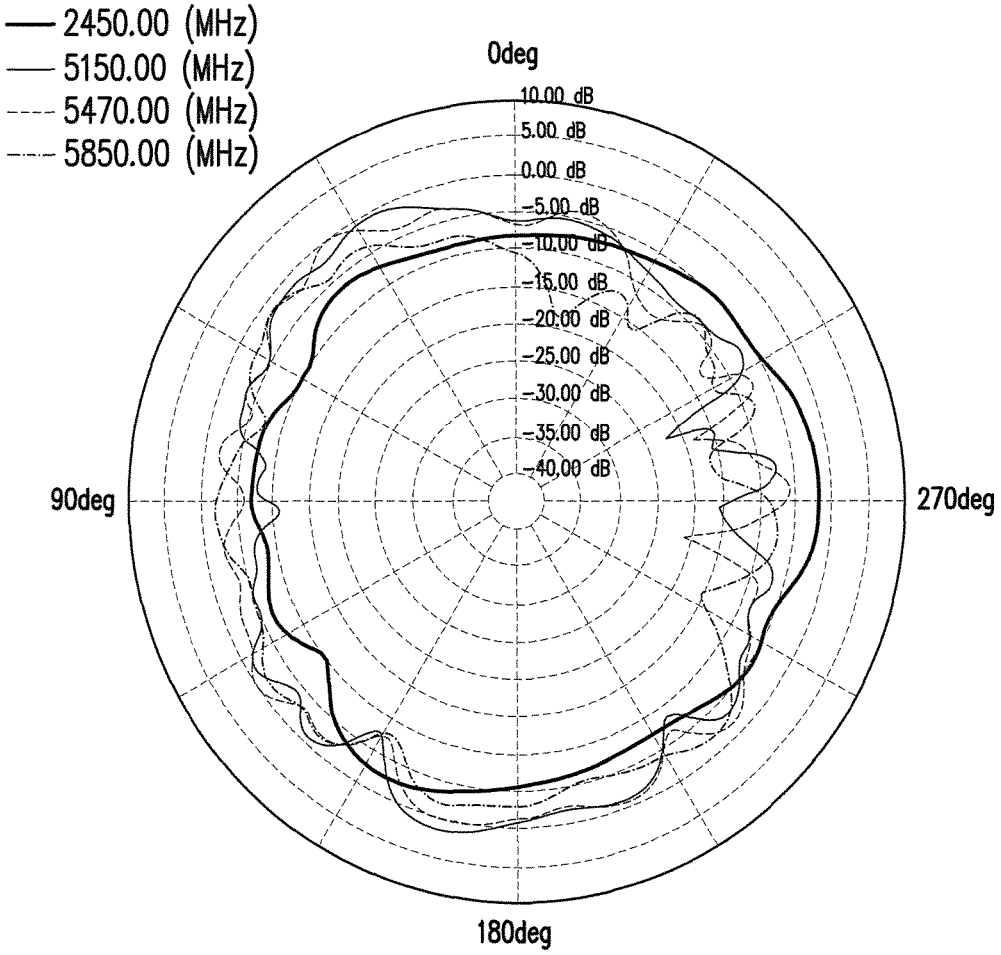
FIG. 5 is a radiation pattern diagram of an antenna element according to an embodiment of the invention.

Additionally, since the antenna element 120 may resist the influence caused by the capacitance effect induced by the metal back cover 320 (e.g., the metal casing body 160), the performance of the antenna element 120 in the metal back cover 320 can be effectively improved, so as to improve the communication quality of the mobile device 100. For example, FIG. 4 is a radiation efficiency diagram of an antenna element according to an embodiment of the invention, and FIG. 5 is a radiation pattern diagram of an antenna element according to an embodiment of the invention. In the embodiment of FIG. 4 and FIG. 5, a length 171 of the antenna element 120 is about 38 mm, and a width 172 of the antenna element 120 is about 9 mm.

As shown in FIG. 4, the radiation efficiency of the antenna element 120 in the first frequency band (i.e., 2.4 GHz frequency band) can be achieved to about −5 dB, and the radiation efficiency of the antenna element 120 in the second frequency band (i.e., 5 GHz frequency band) can be achieved to about −4 dB, so as to meet the application needs of the metal back cover 320. Additionally, referring to a radiation pattern diagram of the antenna element 120 of FIG. 5 on the XY plane, the radiation pattern of the antenna element 120 in the first frequency band (i.e., 2.4 GHz frequency band) is hardly affected by the metal back cover 320, so as to show an omni-direction radiation pattern. On the other hand, since the antenna element 120 has a stronger directivity when operating in the second frequency band (i.e., 5 GHz frequency band), the radiation pattern at 270 degrees is slightly recessed. However, the radiation pattern of the antenna element 120 in the second frequency band still meets the actual application needs.

It should be mentioned that the antenna size of a dual band antenna, which can operate in 2.4 GHz and 5 GHz normally, is often too large and can not be less than 50×9 $mm^2$ in the use of a dual-loop antenna structure. However, in the embodiment of FIG. 1 of the invention, the antenna element 120 combines the loop antenna structure with the inverted-F antenna structure, and the inverted-F antenna structure is surrounded by the loop antenna structure. Thus, the antenna element 120 has an advantage of miniaturization. For example, the size of the antenna element 120 may be about 38×9 $mm^2$. Additionally, the antenna element 120 may further effectively resist the influence caused by the metal back cover 320 (e.g., the metal casing body 160), so as to improve the communication quality of the mobile device 100.

In summary, the antenna element in the mobile device of the invention may form the first path and the second path, so as to operate in the first frequency band and the second frequency band. Additionally, the antenna element may be electrically connected to the ground element through the first radiation portion and the third radiation portion respectively, so as to increase the amount of inductance of the antenna element. Thus, the influence caused by the capacitance effect on the antenna element in the metal environment can be reduced, so as to improve the performance of the antenna element and the communication quality of the mobile device.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. A mobile device, comprising:

a ground element; and an antenna element, comprising:

a first radiation portion, electrically connected between a feeding point and an edge of the ground element, and comprising a first section extending along the edge of the ground element, the first radiation portion forming a first path extending from the feeding point to the edge of the ground element, and the antenna element operating in a first frequency band through the first path, wherein a length of the first path is ½ wavelength of a lowest frequency of the first frequency band;

a second radiation portion, a first end thereof being electrically connected to the first radiation portion, and a second end of the second radiation portion is a first open end; and a third radiation portion, electrically connected between the second radiation portion and the edge of the ground element, the second radiation portion and the third radiation portion being disposed between the first section and the edge of the ground element, the second radiation portion and the third radiation portion forming a second path extending from the first open end to the edge of the ground element, and the antenna element operating in a second frequency band through the second path, wherein a length of the second path is ¼ wavelength of a lowest frequency of the second frequency band.

2. The mobile device according to claim 1, wherein the first radiation portion further comprises:

a second section, extending along the edge of the ground element, and a first end of the second section having the feeding point and electrically connected to the first end of the second radiation portion.

3. The mobile device according to claim 2, wherein the first section, the second section, and the second radiation portion are parallel to the edge of the ground element.

4. The mobile device according to claim 2, wherein the first radiation portion further comprises:

a third section, electrically connected between a second end of the second section and a first end of the first section; and a fourth section, electrically connected between a second end of the first section and the edge of the ground element, and the second radiation portion being disposed between the second section and the fourth section.

5. The mobile device according to claim 4, wherein the third section, the fourth section, and the third radiation portion are perpendicular to the edge of the ground element.

6. The mobile device according to claim 4, wherein the antenna element further comprises an extension portion, a first end of the extension portion is electrically connected to a second end of the first section, a second end of the extension portion is a second open end, and the extension portion adjusts an impedance matching of the antenna element in a double frequency band of the first frequency band.

7. The mobile device according to claim 1, wherein the first radiation portion forms a loop antenna structure, and the second radiation portion and the third radiation portion form an inverted-F antenna structure.

8. The mobile device according to claim 7, further comprising a substrate, and the antenna element and the ground element being disposed on a surface of the substrate.

9. The mobile device according to claim 8, further comprising a metal casing body, and an orthogonal projection of the antenna element on the substrate and an orthogonal projection of the metal casing body on the substrate are overlapped with each other.

10. A mobile device, comprising:

a ground element; and an antenna element, comprising:

a first radiation portion, electrically connected between a feeding point and an edge of the ground element, and comprising a first section extending along the edge of the ground element, the first radiation portion forming a first path extending from the feeding point to the edge of the ground element, and the antenna element operating in a first frequency band through the first path;

a second radiation portion, a first end thereof being electrically connected to the first radiation portion, and a second end of the second radiation portion is a first open end;

a third radiation portion, electrically connected between the second radiation portion and the edge of the ground element, the second radiation portion and the third radiation portion being disposed between the first section and the edge of the ground element, the second radiation portion and the third radiation portion forming a second path extending from the first open end to the edge of the ground element, and the antenna element operating in a second frequency band through the second path; and an extension portion, a first end of the extension portion is electrically connected to a second end of the first section, a second end of the extension portion is a second open end, and the extension portion adjusts an impedance matching of the antenna element in a double frequency band of the first frequency band.

11. The mobile device according to claim 10, wherein the first radiation portion further comprises:

a second section, extending along the edge of the ground element, and a first end of the second section having the feeding point and electrically connected to the first end of the second radiation portion.

12. The mobile device according to claim 11, wherein the first section, the second section, and the second radiation portion are parallel to the edge of the ground element.

13. The mobile device according to claim 11, wherein the first radiation portion further comprises:

a third section, electrically connected between a second end of the second section and a first end of the first section; and a fourth section, electrically connected between a second end of the first section and the edge of the ground element, and the second radiation portion being disposed between the second section and the fourth section.

14. The mobile device according to claim 13, wherein the third section, the fourth section, and the third radiation portion are perpendicular to the edge of the ground element.

15. The mobile device according to claim 10, wherein the first radiation portion forms a loop antenna structure, and the second radiation portion and the third radiation portion form an inverted-F antenna structure.

16. The mobile device according to claim 15, wherein a length of the first path is ½ wavelength of the lowest frequency of the first frequency band, and a length of the second path is ¼ wavelength of the lowest frequency of the second frequency band.

17. The mobile device according to claim 15, further comprising a substrate, and the antenna element and the ground element being disposed on a surface of the substrate.

18. The mobile device according to claim 17, further comprising a metal casing body, and an orthogonal projection of the antenna element on the substrate and an orthogonal projection of the metal casing body on the substrate are overlapped with each other.

* * * * *